US011211744B2

(12) United States Patent
Zhu et al.

(10) Patent No.: US 11,211,744 B2
(45) Date of Patent: Dec. 28, 2021

(54) ELECTRICAL CONNECTOR ASSEMBLY

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jian-Kuang Zhu, Kunshan (CN); Xiao-Juan Lin, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/830,265

(22) Filed: Mar. 26, 2020

(65) Prior Publication Data

US 2020/0313349 A1 Oct. 1, 2020

(30) Foreign Application Priority Data

Mar. 26, 2019 (CN) ..... 201910230901.2
Mar. 26, 2019 (CN) ..... 201920387607.8

(51) Int. Cl.
*H01R 13/627* (2006.01)
*H01R 13/428* (2006.01)
(Continued)

(52) U.S. Cl.
CPC ..... *H01R 13/6273* (2013.01); *H01R 12/7005* (2013.01); *H01R 12/716* (2013.01);
(Continued)

(58) Field of Classification Search
CPC ..... H01R 13/6273; H01R 13/428; H01R 13/639; H01R 12/79; H01R 12/7005;
(Continued)

(56) References Cited

U.S. PATENT DOCUMENTS 4,008,941 A * 2/1977 Smith ..... H01R 24/50 439/358
7,828,585 B2 * 11/2010 Kurimoto ..... H01R 12/716 439/468
(Continued)

FOREIGN PATENT DOCUMENTS

TW 558023 I 11/2016

*Primary Examiner* — Abdullah A Riyami
*Assistant Examiner* — Nelson R. Burgos-Guntin
(74) *Attorney, Agent, or Firm* — Ming Chieh Chang; Wei Te Chung

(57) ABSTRACT

A receptacle connector includes an insulative receptacle housing and a plurality of receptacle contacts retained in the receptacle housing. The plug connector includes an insulative plug housing and a plurality of plug connectors retained in the plug connector. The receptacle housing includes a rear wall extending along a lengthwise direction, and a pair of side walls extending from two opposite ends of the rear wall along the front-to-back direction perpendicular of the lengthwise direction, to commonly form a receiving space thereamong. The receiving space forms a front opening and an upper opening for communicating with an exterior. The receptacle contacts are retained in the rear wall and extend into the receiving space. The plug connector is adapted to be rearwardly inserted into the receiving space along the front-to-back direction via the front opening, or be downwardly and rotationally inserted into the receiving space via the upper opening.

10 Claims, 17 Drawing Sheets

(51) Int. Cl.

| | |
|---|---|
| ***H01R 13/639*** | (2006.01) |
| ***H01R 12/79*** | (2011.01) |
| ***H01R 12/70*** | (2011.01) |
| ***H01R 12/71*** | (2011.01) |
| *H01R 107/00* | (2006.01) |

(52) U.S. Cl.
CPC ..... *H01R 12/79* (2013.01); *H01R 13/428* (2013.01); *H01R 13/639* (2013.01); *H01R 2107/00* (2013.01)

(58) Field of Classification Search
CPC ..... H01R 12/716; H01R 2107/00; H01R 12/707; H01R 13/115; H01R 13/6275; H01R 13/432
USPC ..... 439/352
See application file for complete search history.

(56) References Cited

U.S. PATENT DOCUMENTS 8,043,114 B2 * 10/2011 Kaneko ..... H01R 12/716 439/497
9,048,569 B2 * 6/2015 Chen ..... H01R 13/6275
9,240,653 B2 * 1/2016 Urano ..... H01R 13/6273
9,287,643 B2 * 3/2016 Yoshida ..... H01R 12/75
9,306,325 B2 * 4/2016 Cheng ..... H01R 12/88
9,570,856 B2 * 2/2017 Sato ..... H01R 13/6471
9,748,677 B2 * 8/2017 Urano ..... H01R 12/91
9,991,631 B2 * 6/2018 Zhao ..... H01R 13/428
10,985,479 B2 * 4/2021 Buck ..... H01R 12/714
2006/0094304 A1 * 5/2006 Masaki ..... H01R 12/75 439/850
2006/0094306 A1 * 5/2006 Masaki ..... H01R 13/567 439/850
2011/0151708 A1 * 6/2011 Kaneko ..... H01R 12/775 439/404
2011/0306229 A1 * 12/2011 Katsui ..... H01R 24/005 439/345
2013/0143444 A1 * 6/2013 Chen ..... H01R 13/518 439/626
2016/0156116 A1 * 6/2016 Kurachi ..... H01R 13/6581 439/78
2016/0308308 A1 * 10/2016 Masunaga ..... H01R 13/6581
2017/0229825 A1 * 8/2017 Baines ..... H01R 25/006
2019/0267732 A1 * 8/2019 Buck ..... H01R 12/7047
2019/0319395 A1 * 10/2019 Bakshan ..... H01R 13/514
2020/0313349 A1 * 10/2020 Zhu ..... H01R 13/6273
2021/0126404 A1 * 4/2021 Laurx ..... H01R 12/7005

* cited by examiner

ELECTRICAL CONNECTOR ASSEMBLY

BACKGROUND OF THE INVENTION

1. Field of the Invention

The present invention relates generally to an electrical connector assembly, and particularly to the connector assembly essentially composed to a receptacle connector and a plug connector which is adapted to be mated to the receptacle connector either in a horizontal way or in a downward rotation way.

2. Description of Related Arts

Taiwan patent M446425 discloses a receptacle connector for mating with a plug/cable connector. Such a mating is done via a vertical way. Anyhow, in some situation when the user does not know the correct mating way but trying via a horizontal way, one of the receptacle connector and the plug connector may be damaged.

Hence, an electrical connector assembly essentially composed of the electrical connector and the plug connector mated with each other via either a horizontal way or a vertical way, is desired.

SUMMARY OF THE INVENTION

To achieve the above object, an electrical connector assembly includes a receptacle connector for mounting upon a printed circuit board, and a plug connector mateable with the receptacle connector and linked with a cable. The receptacle connector includes an insulative receptacle housing and a plurality of receptacle contacts retained in the receptacle housing. The plug connector includes an insulative plug housing and a plurality of plug connectors retained in the plug connector. The receptacle housing includes a rear wall extending along a lengthwise direction, and a pair of side walls extending from two opposite ends of the rear wall along the front-to-back direction perpendicular of the lengthwise direction, to commonly form a receiving space thereamong. The receiving space forms a front opening and an upper opening for communicating with an exterior. The receptacle contacts are retained in the rear wall and extend into the receiving space. The plug connector is adapted to be rearwardly inserted into the receiving space along the front-to-back direction via the front opening, or be downwardly and rotationally inserted into the receiving space via the upper opening. The receptacle connector includes a pair of latches on two side walls. The plug connector includes a pair of locking grooves so as to have the corresponding latches engaged therein. The receptacle connector includes a pair of retaining spaces to receive the corresponding latches therein wherein the latch further includes a mounting leg for mounting upon the printed circuit board. The plug housing forms a pair of positioning blocks at the front end, and the rear wall of the receptacle connector forms a pair of positioning holes to receive the corresponding positioning blocks so as to restrain the plug housing with regard to the receptacle housing.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
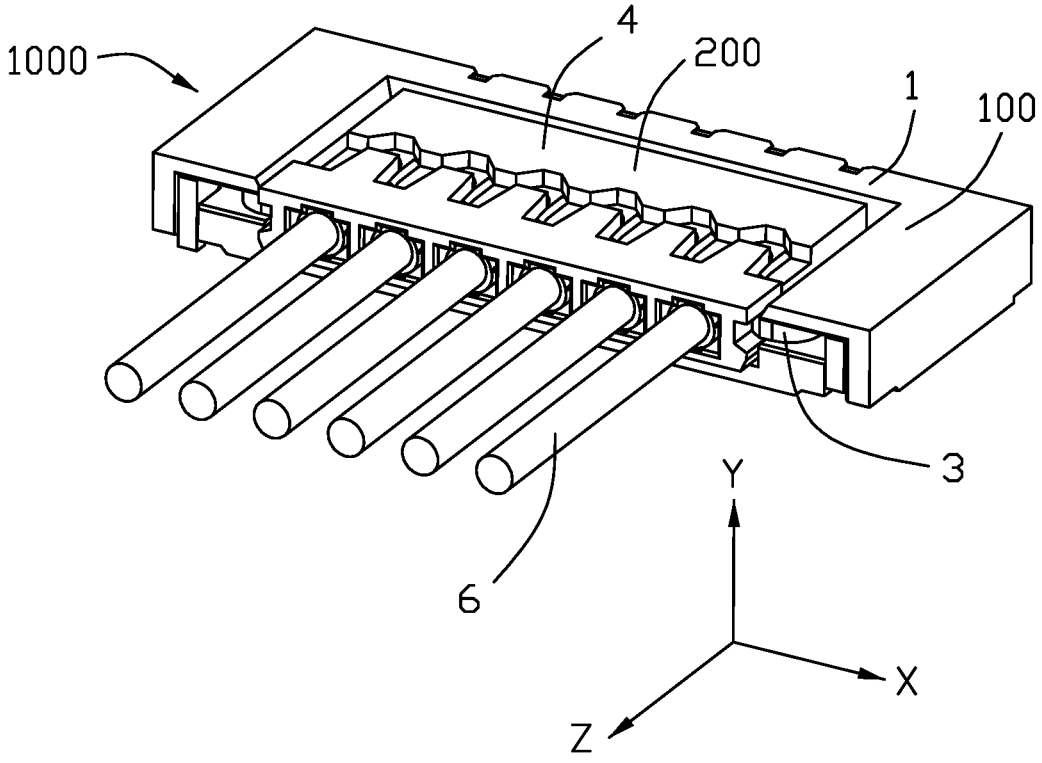
FIG. 1 is a perspective view of the electrical connector assembly of a first preferred embodiment of the present invention.
Figure 2:
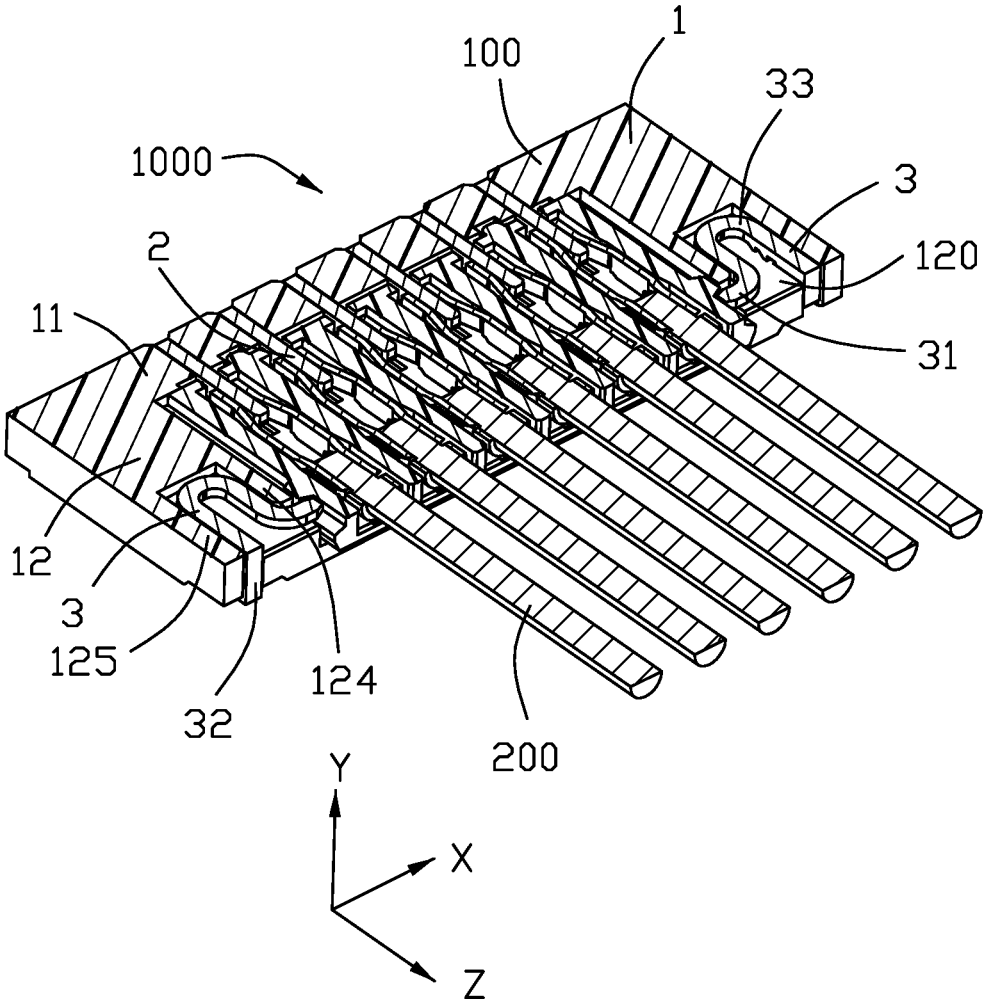
FIG. 2 is a cross-sectional perspective view of the electrical connector assembly of FIG. 1.
Figure 3:
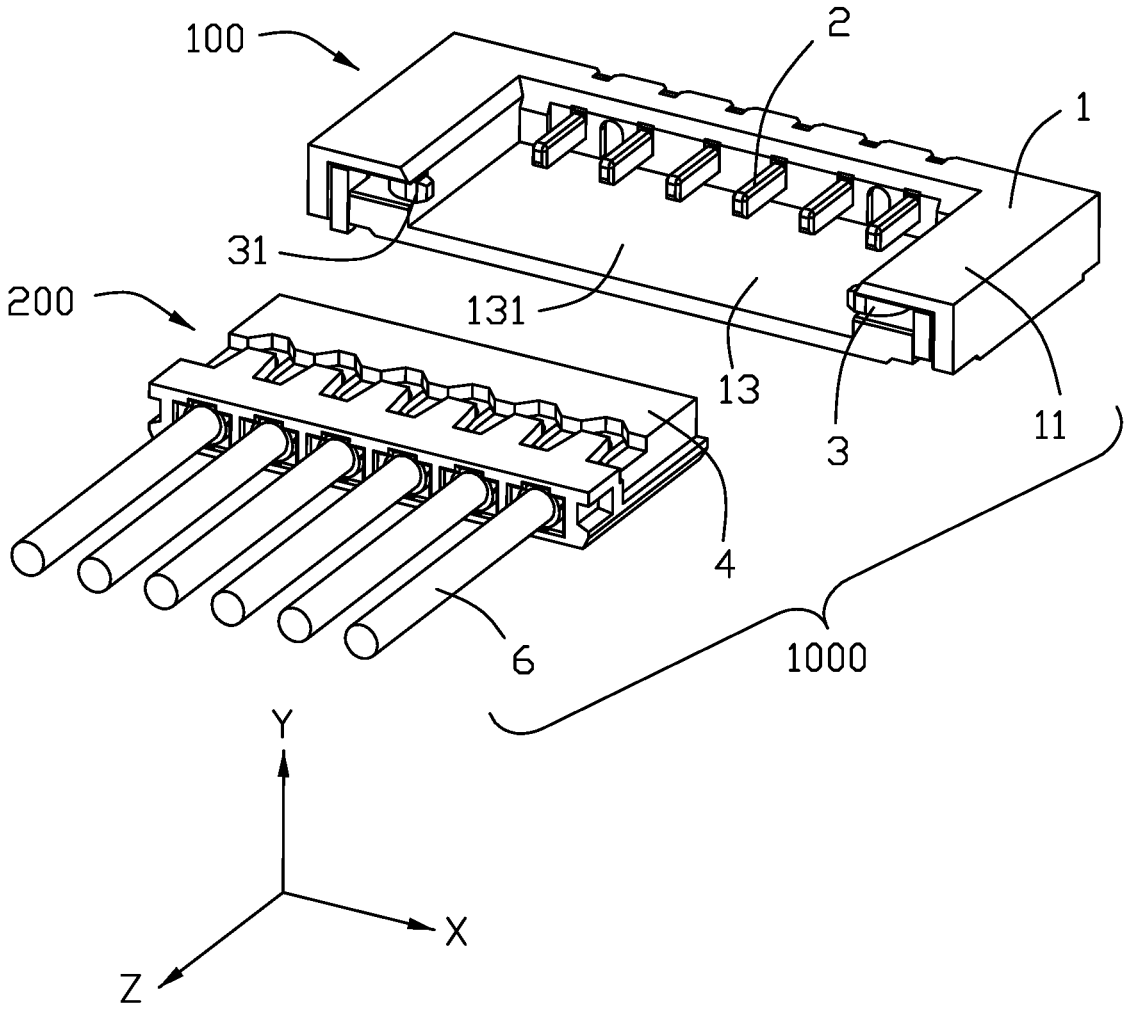
FIG. 3 is an exploded perspective view of the electrical connector assembly of FIG. 1.
Figure 4:
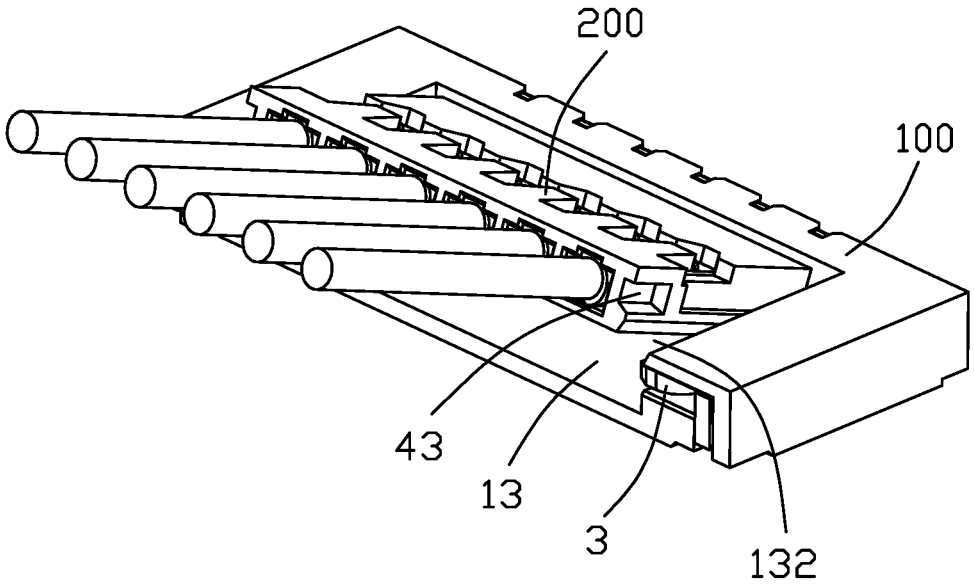
FIG. 4 is a perspective view of the electrical connector assembly of FIG. 3 when the plug connector is mated with the receptacle connector in a downward rotation way.
Figure 5:
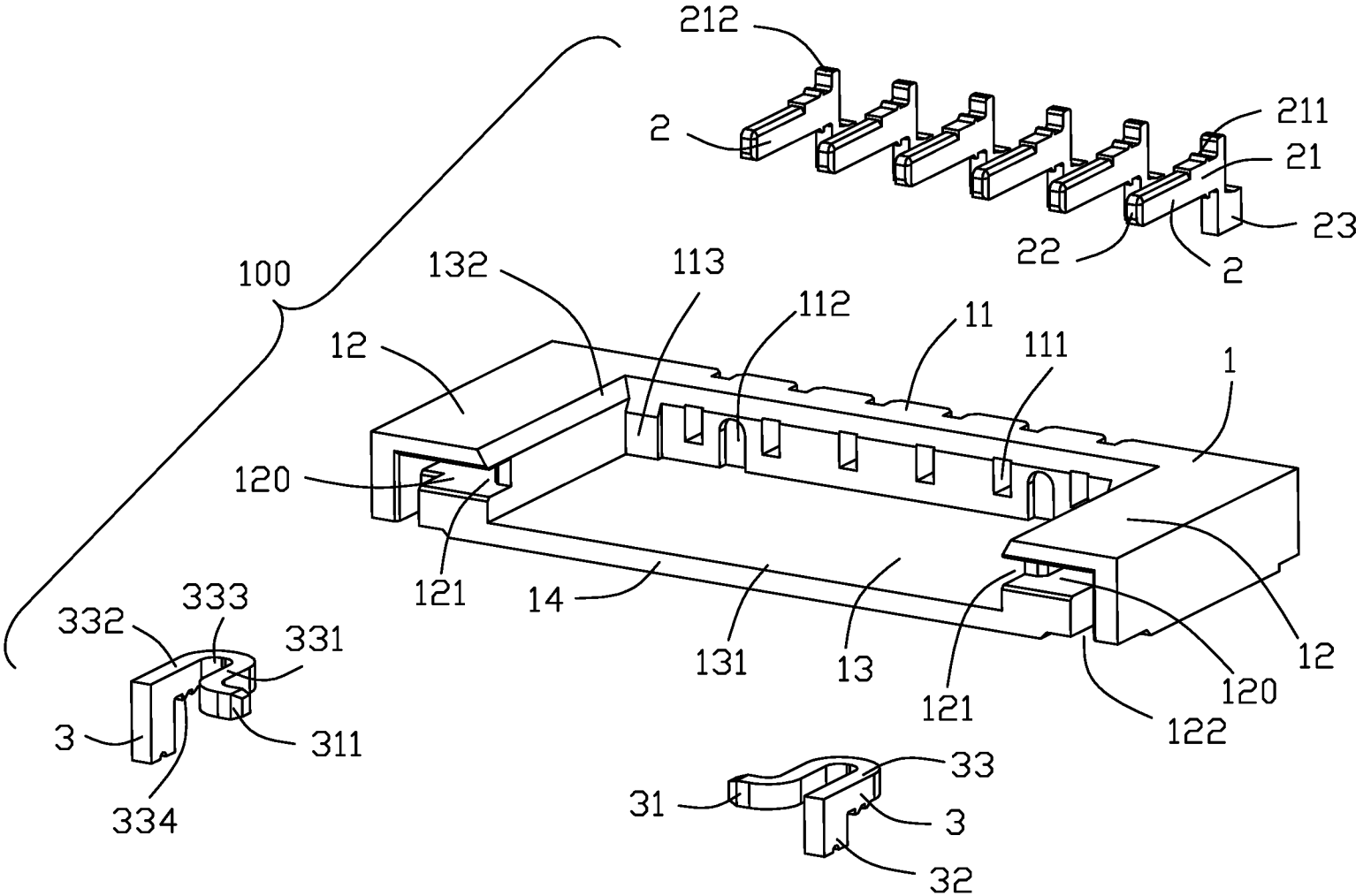
FIG. 5 is an exploded perspective view of receptacle connector of FIG. 3.
Figure 6:
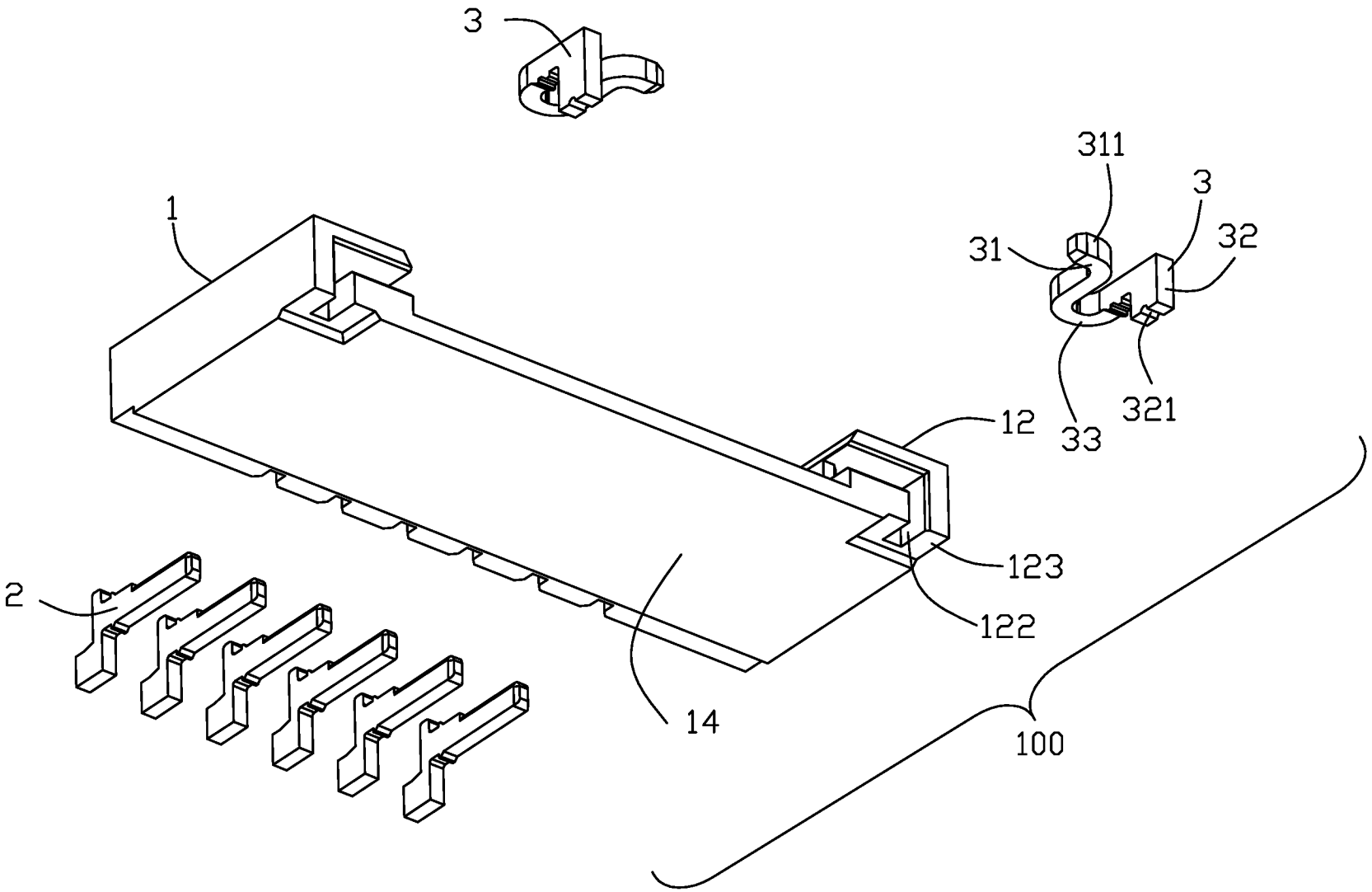
FIG. 6 is another exploded perspective view of the t receptacle connector of FIG. 5.
Figure 7:
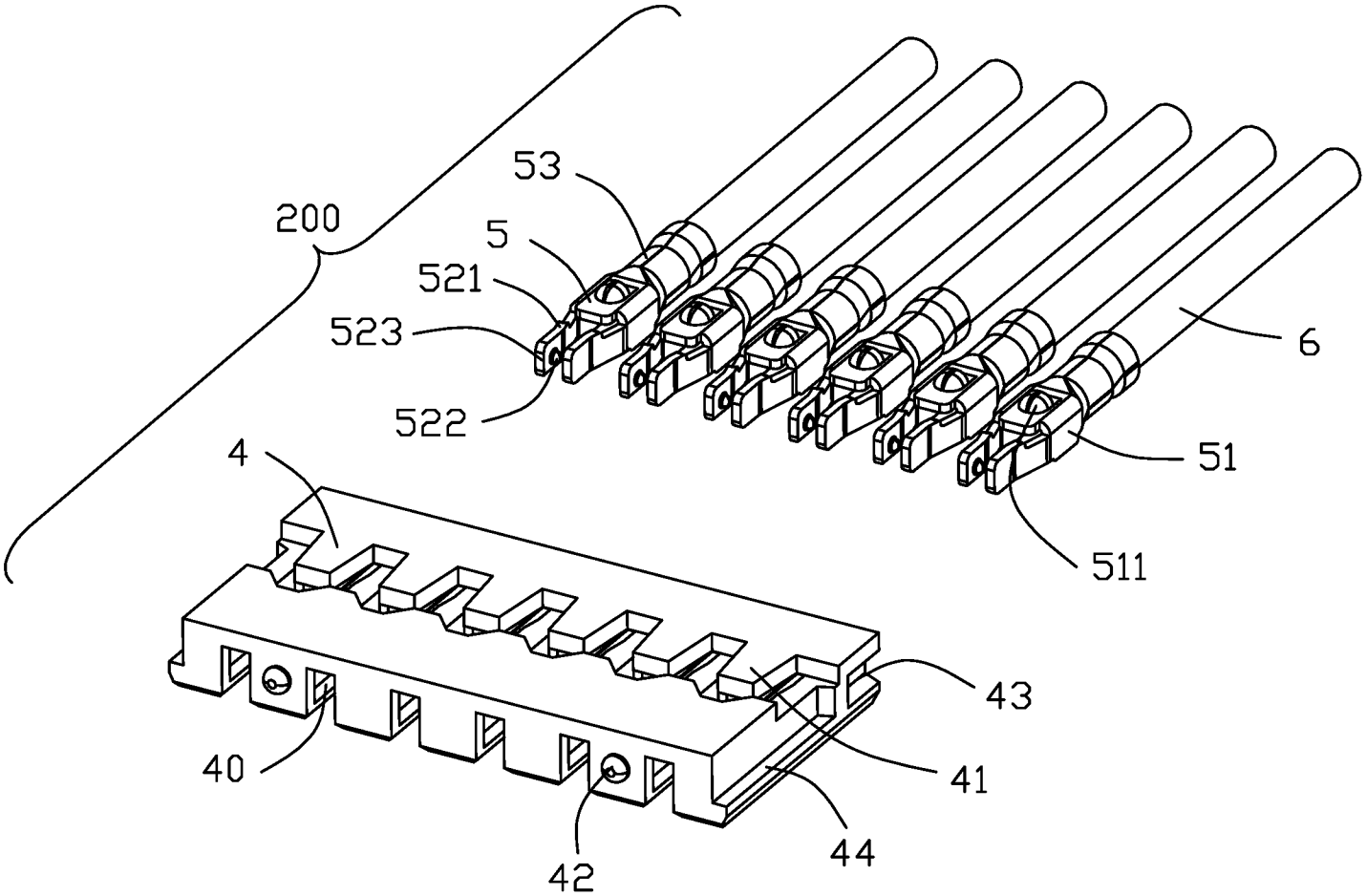
FIG. 7 is an exploded perspective view of the plug connector of FIG. 3.
Figure 8:
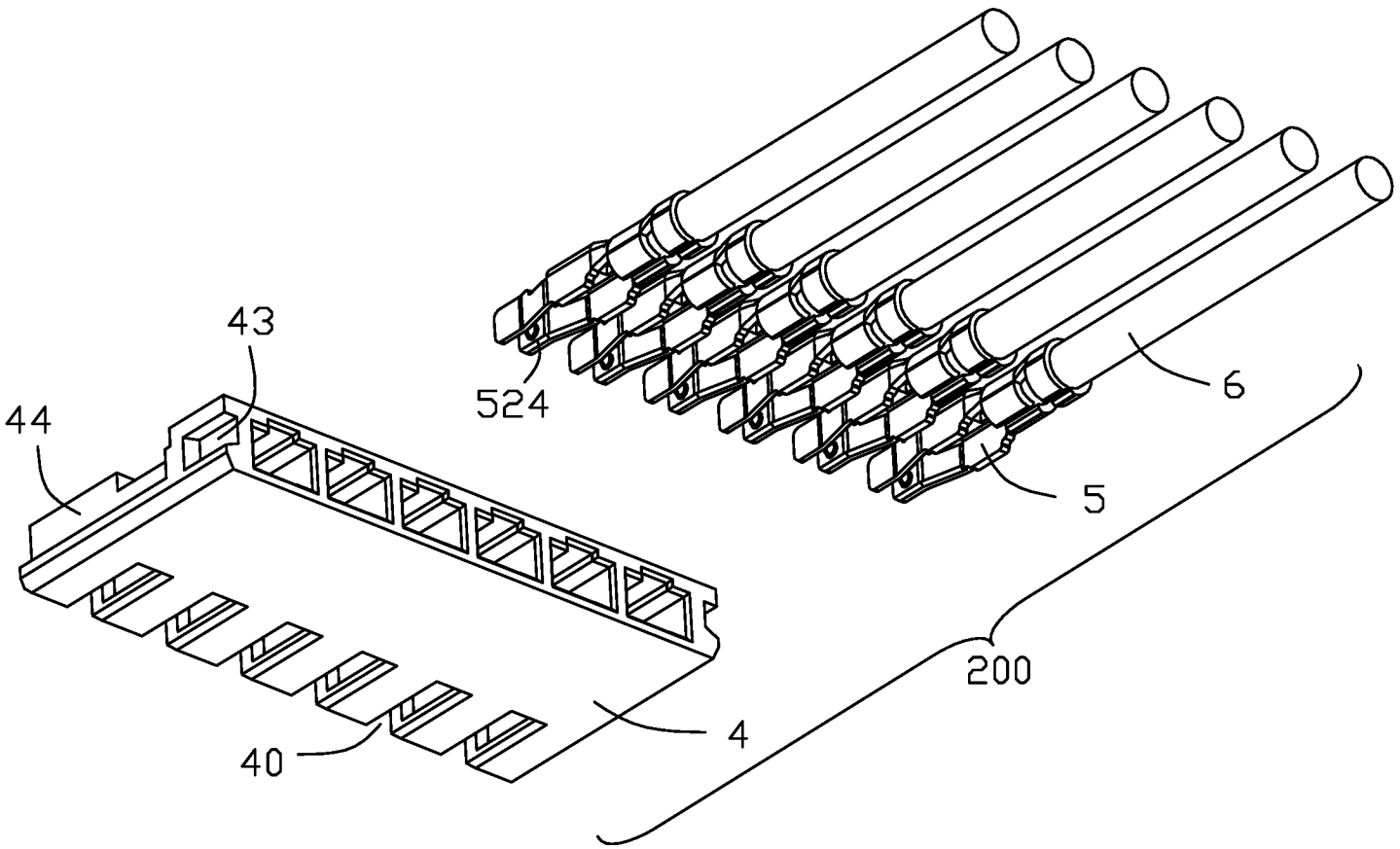
FIG. 8 is another exploded perspective view of the plug connector of FIG. 7.

Referring to FIGS. 1-8, an electrical connector assembly 1000 includes a receptacle connector 100 for mounting to a printed circuit board (not shown) and a plug connector 200 mated with the receptacle connector 100 wherein the lengthwise direction X, the vertical direction Y and the front-to-back direction Z perpendicular to one another. In this embodiment, the plug connector 200 can be mated with the receptacle connector via the front-to-back direction Z or a downward direction in a rotational manner.

The receptacle connector 100 includes an insulative receptacle housing 1, a plurality of receptacle contacts 2 retained in the receptacle housing 1, and a pair of metallic latches 3. The receptacle housing 1 includes a rear wall 11 extending along the lengthwise direction X, a pair of side walls 12 extending from two opposite ends of the rear wall 11 along the front-to-back direction Z, so as to commonly form a receiving space 13. A bottom wall 14 is linked with the rear wall 11 and the side walls 12 and located under the receiving space 13. The receiving space 13 communicates with the exterior via a front opening 131 along the front-to-back direction X, and a top opening 132 along the vertical direction Y. The receptacle contacts 2 are retained in the rear wall 11. The front end of the bottom wall 14 is flush with the front ends of the side walls 12. The bottom wall 14 may be omitted for reducing the height of the receptacle connector 100.

The side wall 12 includes a retaining space 120 forwardly communicating with the exterior to retain the corresponding latch 3 therein. The retaining space 120 includes a first recess 121 to sidewardly communicate with the receiving space 13, and a second recess 122 to communicate with the printed circuit board (not shown). The latch 3 includes a locking part 31 extending through the first recess 121 into the receiving space 13, and a mounting part 32 extending through the second recess 122 for mounting to the printed circuit board (not shown), and a U-shaped spring arm 33 linked between the locking part 31 and the mounting part 32. The locking part 31 forms the guiding surfaces 311 so as to allow the corresponding plug connector 200 to be mated with the receptacle connector 100 either along the front-to-back direction X, i.e., the horizonal way, or in the vertical rotational direction Y, i.e., the downward rotational way. The U-shaped spring arm 33 includes a first/inner arm 331, a second arm 332 and a third arm linked between the first arm 331 and the second/outer arm 332. The locking part 31 extends from a front end of the first arm 331, and the mounting part 32 extends from the front end of the second arm 332. The side wall 12 includes a first partition wall 124 confronting the first arm 331, and a second partition wall 125 confronting the second arm 332. Notably, the first arm 331 may provide the sufficient resiliency for the locking part 31. The second arm 332 forms barbs 334 to efficiently retain the whole latch 3 in position within the retaining space 120.

The side wall 12 forms a recess 123, and the mounting part 32 extends into the recess 123. The mounting part 32 forms a recess 321 to receive more solder during mounting. The rear wall 11 forms plurality of passageways 111 to receive the corresponding receptacle contacts 2, respectively, and a pair of positioning holes 112 for retaining the plug connector 200 (illustrated later). Each receptacle contact 2 includes a retaining section 21, a contacting section 22 extending into the receiving space 13, and a mounting section 23 for mounting to the printed circuit board (not shown). The retaining section 21 forms barbs 211 and a shoulder 212 abutting against the rear wall 11. A pair of standoffs 113 are formed at two opposite ends of the rear wall 11.

The plug connector 200 includes a plug housing 4, a plurality of plug contacts 4 retained in the plug housing 4, and a plurality of wires 6 respectively connected to the corresponding plug contacts 4.

The plug contact 5 includes a retaining section 51, a contacting section 52 and a connecting section 53 connected to opposite ends of the retaining section 51. The contacting section 52 includes a pair of spring arms 521, and the connecting section 53 grasps the wire 6. The plug housing 4 forms a plurality of mating slots 40 each communicating with the exterior in both the front-to-back direction Z and the vertical direction Y to receive the contacting sections 22 of the receptacle contact 2 in either the front-to-back direction Z and the vertical direction Y. The pair of spring arms 521 is exposed to the mating slot 40 to sandwich the corresponding contacting section 22 of the receptacle contact 2. The pair of spring arms form corresponding front guiding sections 523 for facilitating mating along the front-to-back direction Z, and corresponding lower guiding sections 524 for facilitating mating along the vertical direction in a rotational manner. A pair of protrusions 522 are formed on the pair of spring arms 521. The retaining section 521 forms a protrusion 511 to abut against the stopper 41 on the housing 4.

The housing further forms a pair of locking grooves 43 and a pair of offsetting grooves 44 in two opposite lateral sides. During mating along the front-to-back direction, the locking part 31 of the latch 3 moves along the offsetting groove 44 and passes over the ramp and finally stops in the locking groove 43.

The housing 4 further forms a pair of positioning blocks 42. During mating in a vertical rotational way, initially the pair of positioning blocks 42 are received within the corresponding positioning holes 112 in a slanting manner, and successively the housing 4 is downwardly moved in a rotational manner to have the locking part 31 engaged within the locking groove 13.

Figure 9:
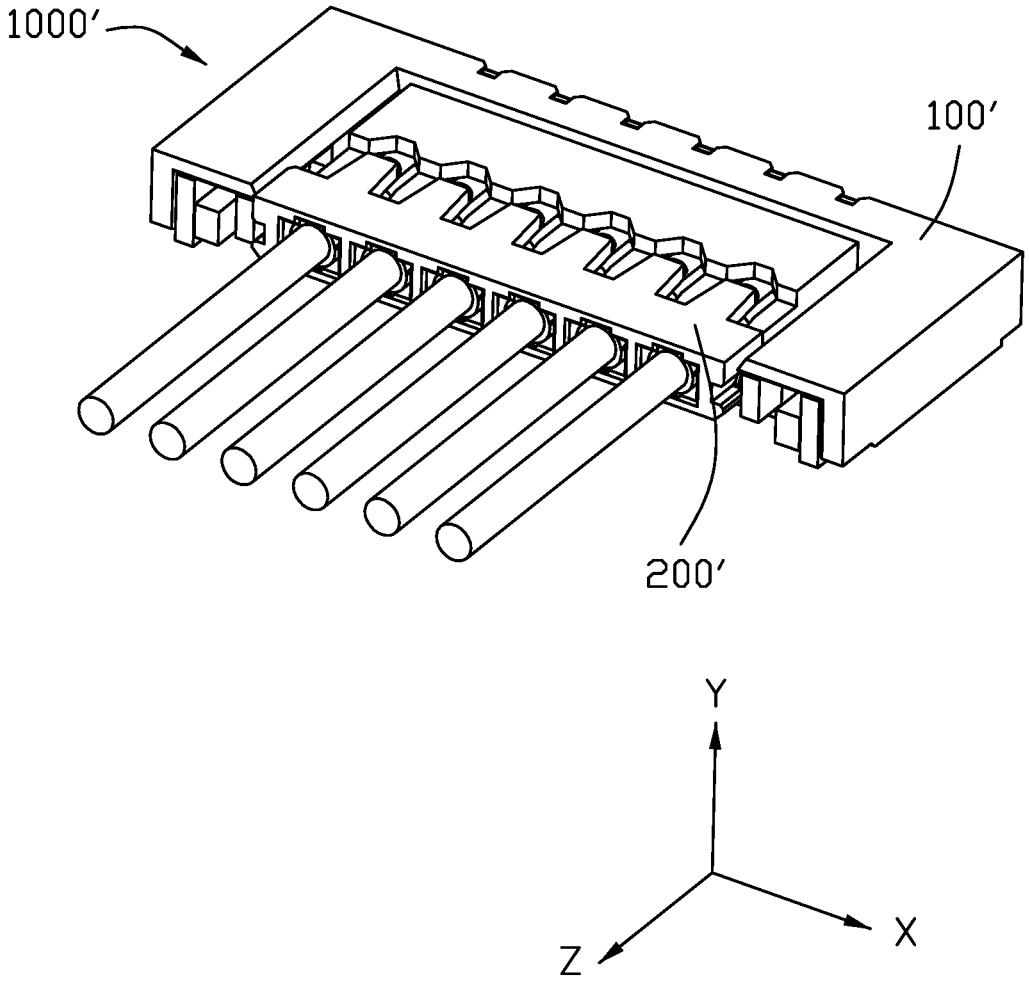
FIG. 9 is a perspective view of the electrical connector assembly according to a second embodiment of the invention.
Figure 10:
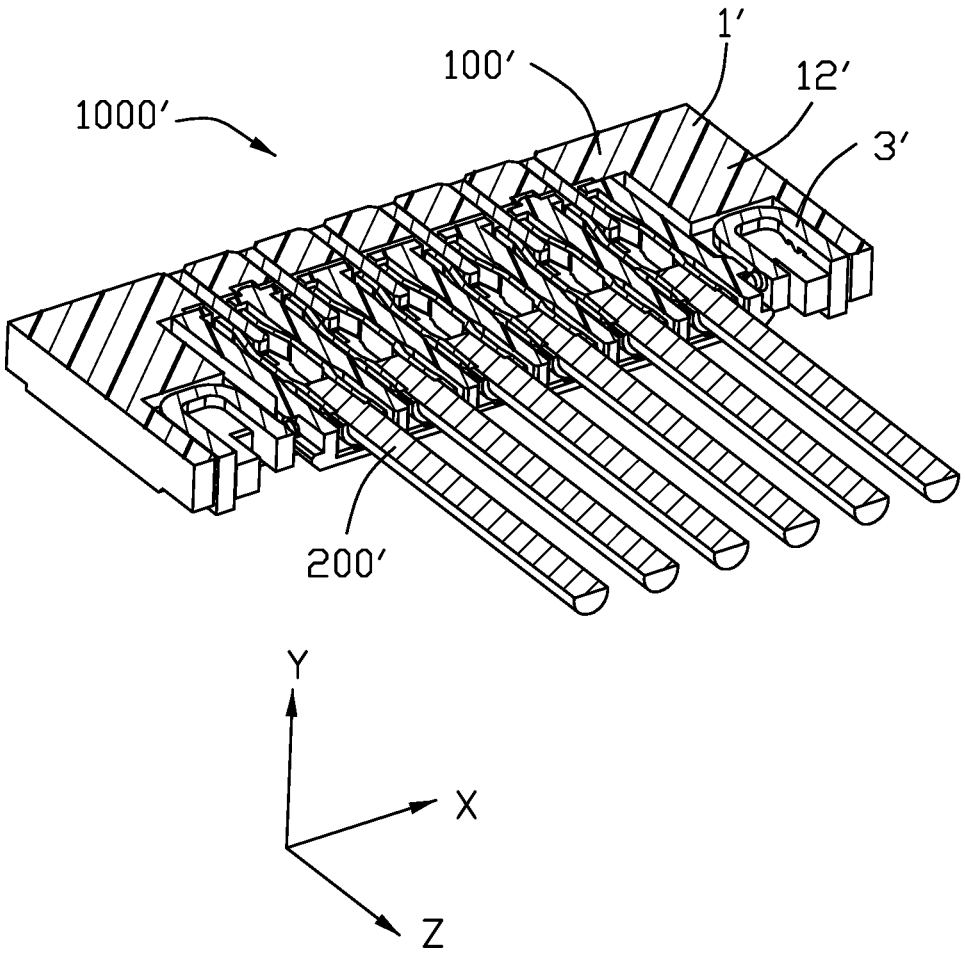
FIG. 10 is cross-sectional perspective view of the electrical connector assembly of FIG. 9.
Figure 11:
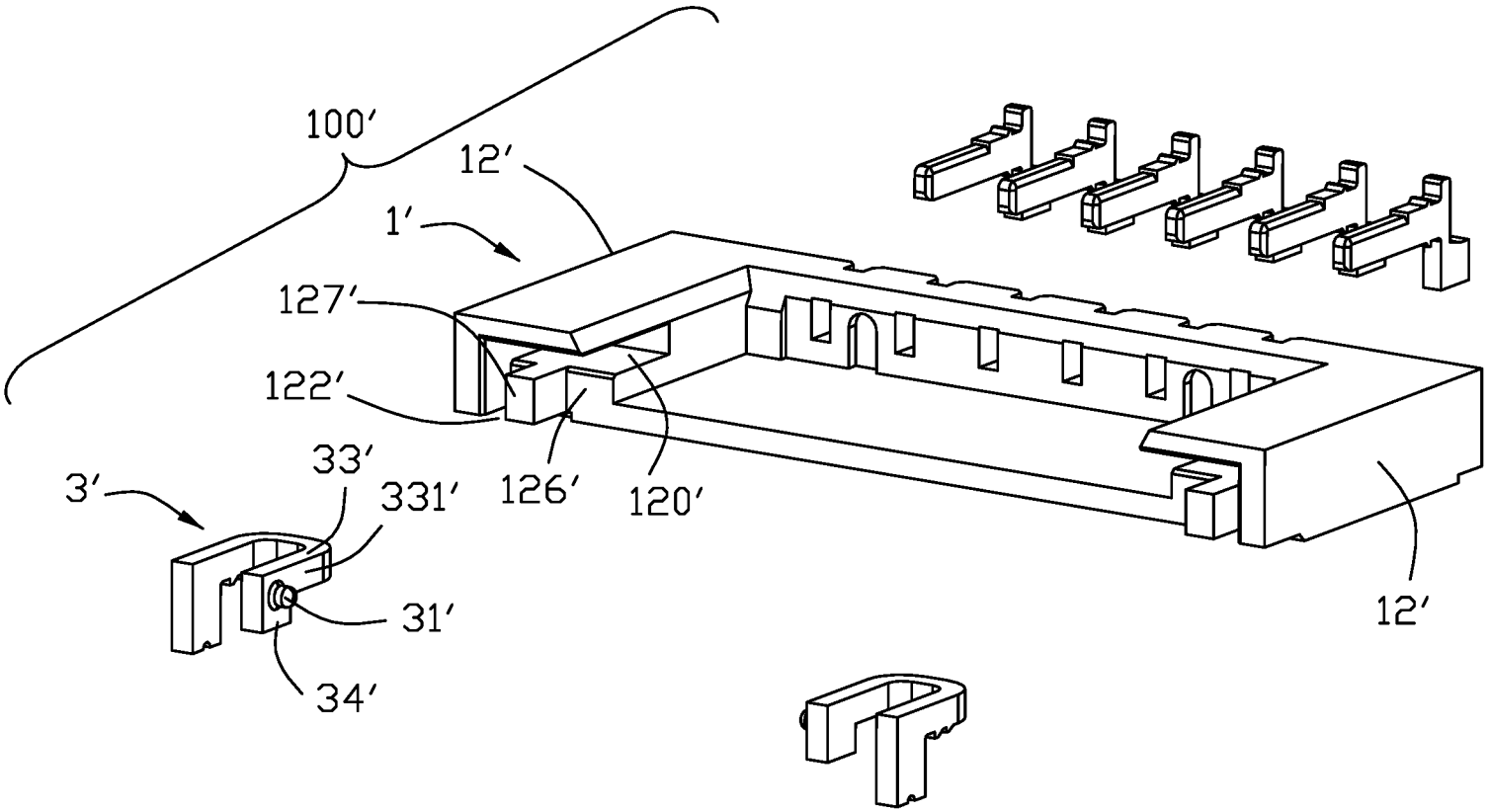
FIG. 11 is an exploded perspective view of the receptacle connector of FIG. 9.
Figure 12:
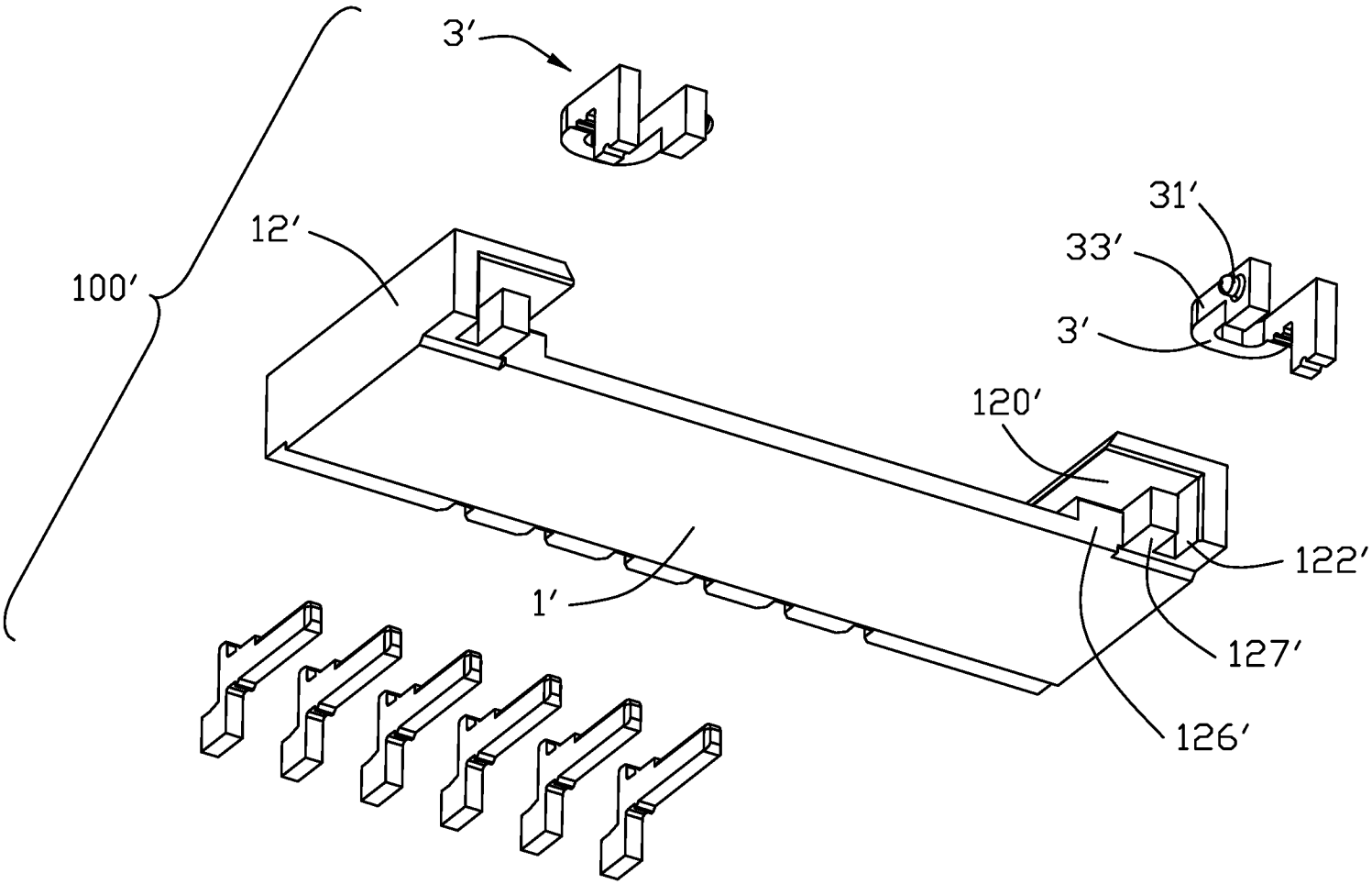
FIG. 12 is another explode perspective view of the receptacle connector of FIG. 11.

Referring to FIGS. 9-12, the electrical connector assembly 1000' has the similar structure with the first embodiment 1000 except the locking part 31' is an embossment formed on an inner face of the first arm 331' of the spring arm 33'. An extension 34' is formed below the locking part 31', and a recess 126' is formed in the housing 1' to accommodate the extension 34'. The side wall 12' forms a protrusion 127' between the recess 126' and the second recess 122' to form a stopper against the extension 34'.

Figure 13:
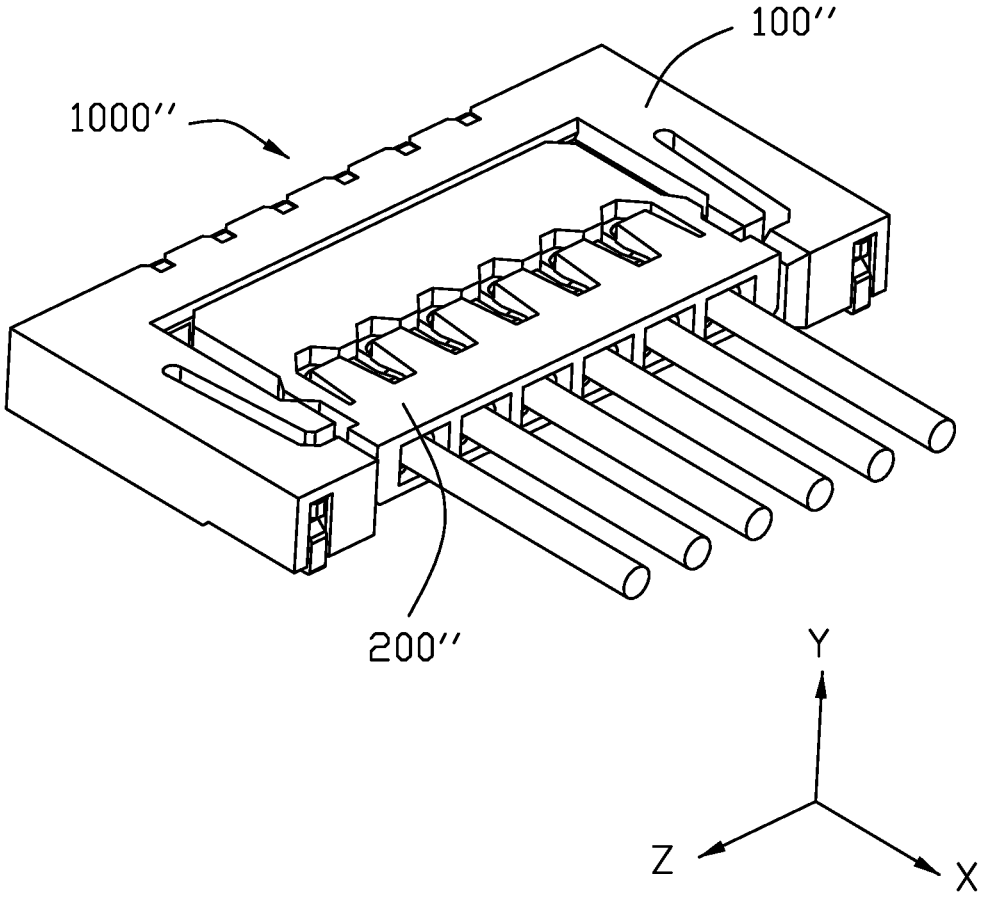
FIG. 13 is a perspective view of the electrical connector assembly according to a third embodiment of the invention.
Figure 14:
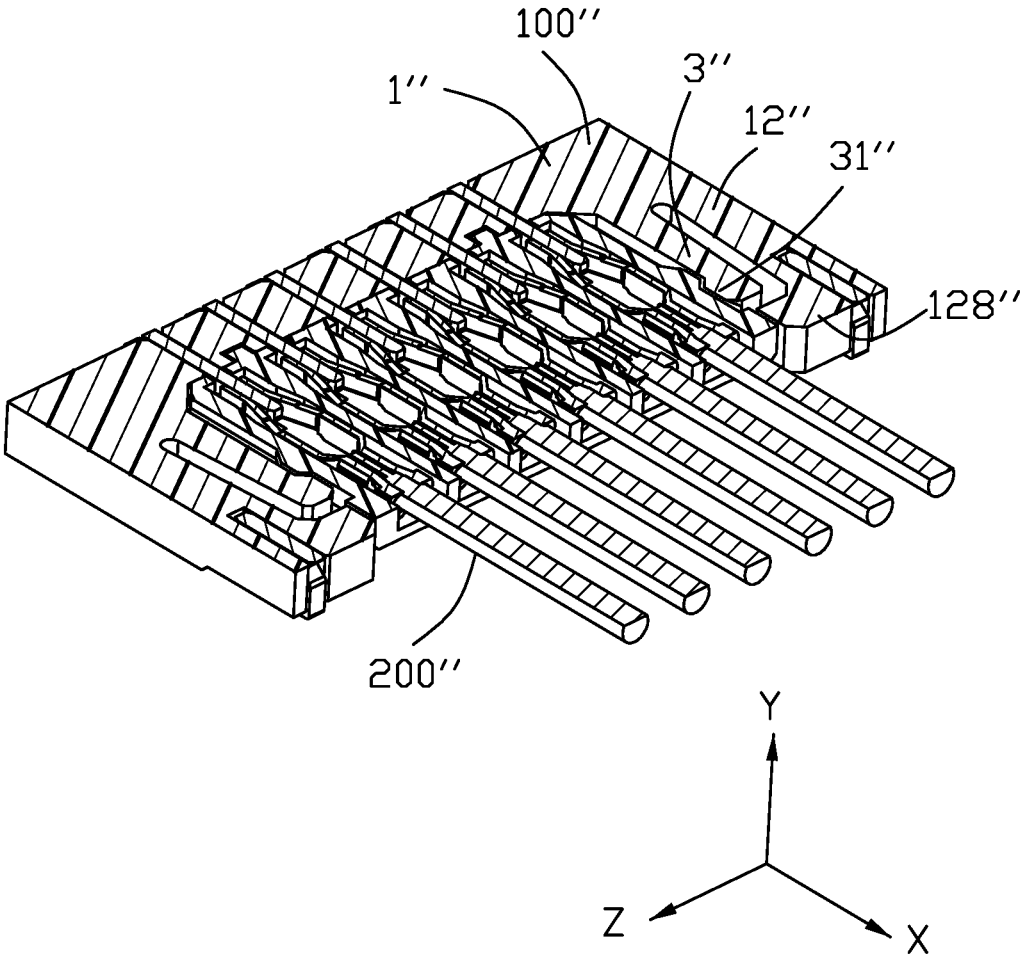
FIG. 14 is a cross-sectional perspective view of the electrical connector assembly of FIG. 13.
Figure 15:
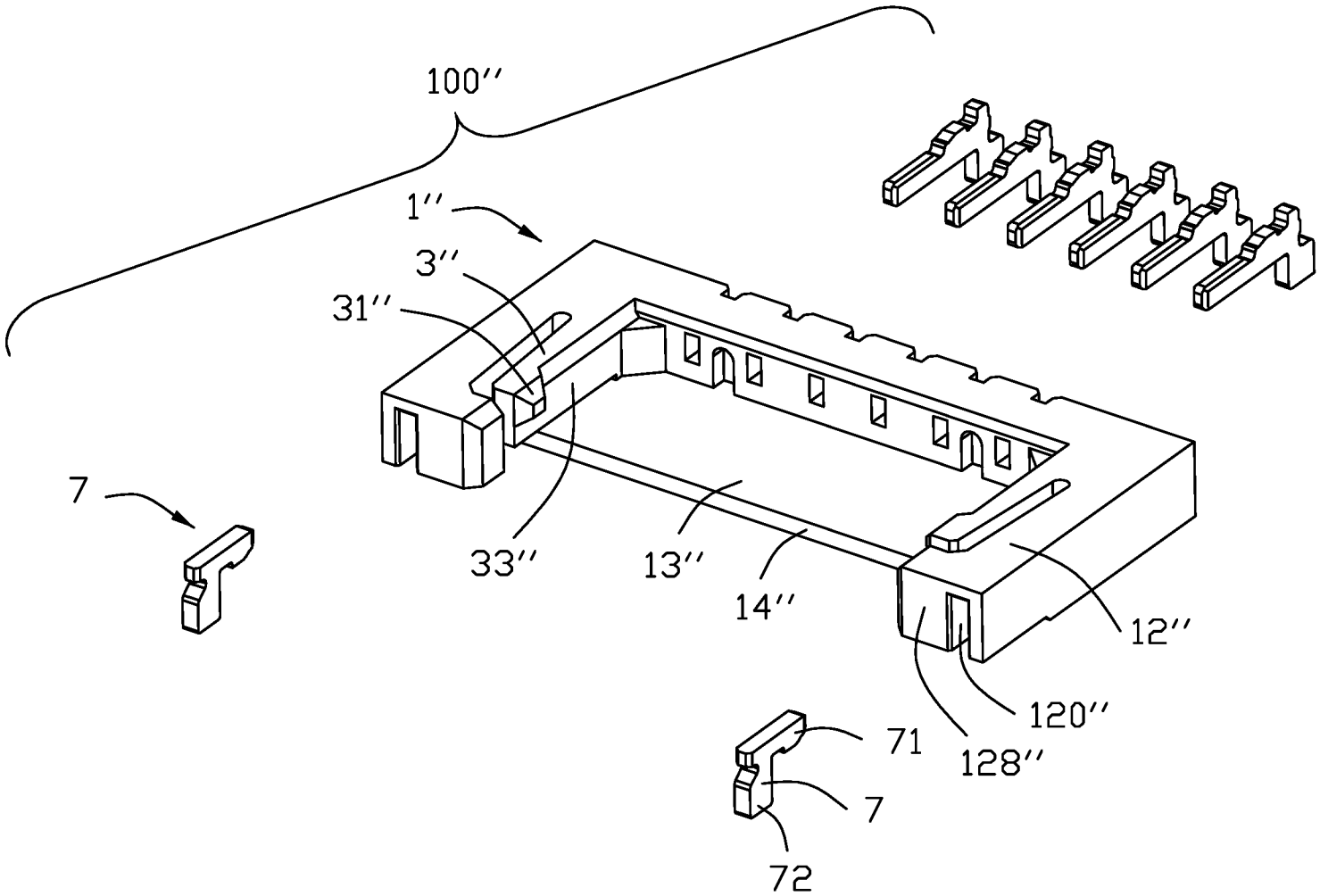
FIG. 15 is an exploded perspective view of the receptacle connector of FIG. 13.
Figure 16:
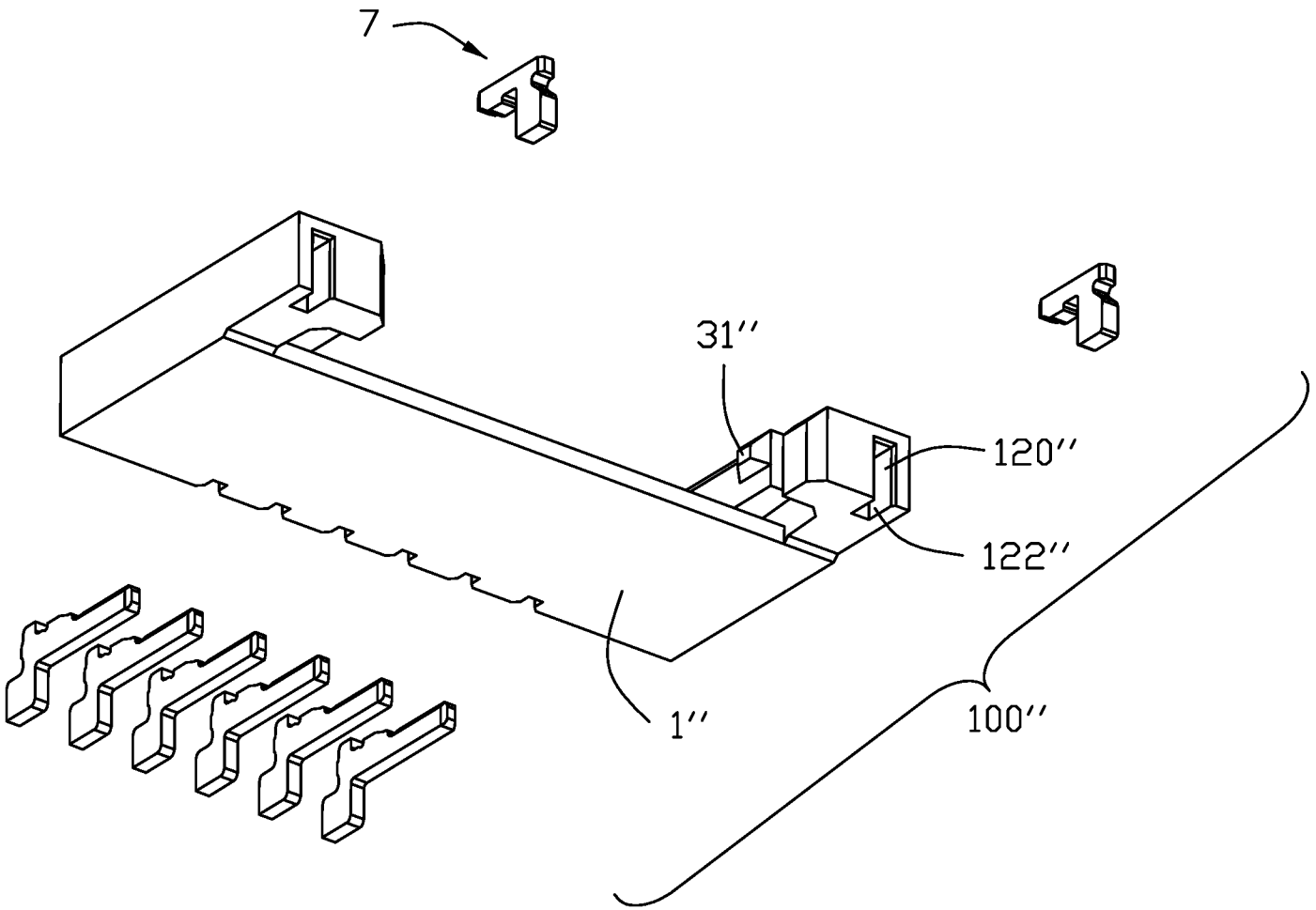
FIG. 16 is another exploded perspective view of the receptacle connector of FIG. 15.
Figure 17:
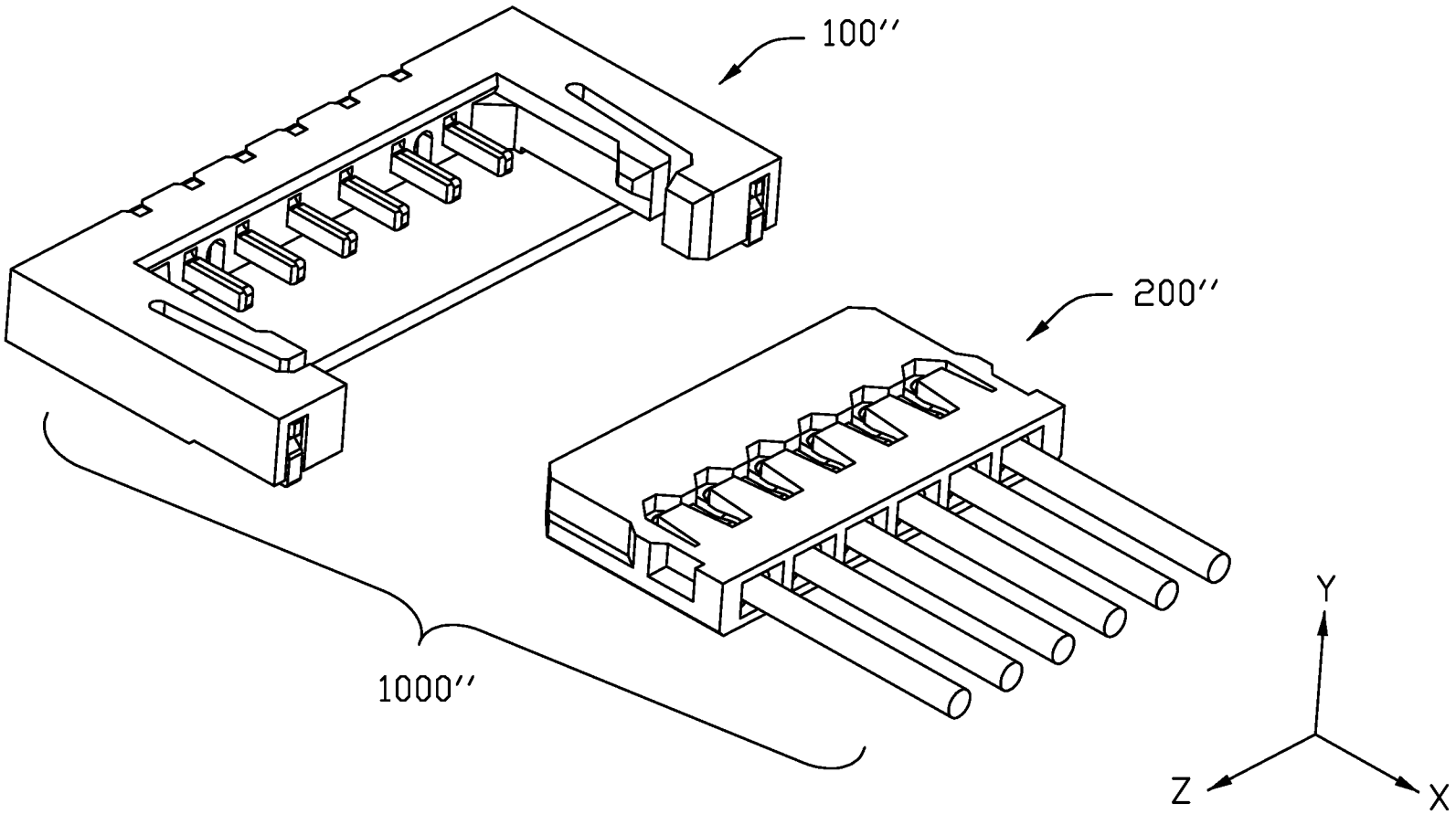
FIG. 17 is an exploded perspective view of the electrical connector assembly of FIG. 13.

Referring to FIGS. 13-16, the electrical connector 1000" has the similar structure with the first embodiment 1000 except the latch 3" is unitarily formed on the side wall 12" of the housing 1", and the locking part 31" is formed at the free end of the latch 3". The side wall 12" forms a restriction block 128" to protect the latch 3". A gap is formed between the latch 3" and the bottom wall 14" for not blocking the latch 3". The receptacle connector 100" further includes a pair of mounting pieces 7" retained in the retaining space 120". The mounting piece 7" includes a main body 71", and the soldering part 72". The soldering part 72" extends out of the second recess 122" for mounting to the printed circuit board.

The invention allows the plug connector to be mated with the receptacle connector in either the horizontal direction, or the vertical direction in a rotational way. The first embodiment and the second embodiment provide a metallic latch to be assembled into the retaining space of the housing while the third embodiment provides an unitary latch with the housing. The metallic latch further includes the mounting part soldered upon the printed circuit board. The U-shaped structure of the latch enhances resiliency thereof. The locking part forms guiding surfaces in both the horizontal direction and the vertical direction so as to allow the plug housing to be inserted into the receiving space of the receptacle housing in either the horizontal direction, or the vertical direction via a rotational way. Understandably, the latch has the corresponding resilient structure to be outwardly deflected in the lengthwise direction during mating for not blocking the insertion of the plug housing into the receptacle housing or withdrawal of the plug housing from the receptacle housing.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector assembly comprising:

a receptacle connector and a plug connector adapted to be mated with each other, the receptacle connector including:

an insulative receptacle housing having a rear wall extending along a lengthwise direction, and a pair of side walls extending from two opposite ends of the rear wall along a front-to-back direction perpendicular to the lengthwise direction, all the rear wall and the pair of side walls commonly forming a receiving space thereamong;

a plurality of contacts retained to the rear wall with corresponding contacting sections extending into the receiving space;

a pair of retaining spaces formed in the corresponding side walls, respectively; and a pair of metallic deflectable latches retained in the corresponding retaining spaces, respectively, each of said metallic latches forming a locking part extending into the receiving space in the lengthwise direction;

the plug connector including:

an insulative plug housing, a plurality of plug contacts retained in the plug housing, and a plurality of wires for being connected to the plug contacts, respectively, wherein the plug housing is adapted to be inserted into the receiving space either in the front-to-back direction, or in a vertical direction perpendicular to both the front-to-back direction and the lengthwise direction via a rotational manner; wherein the locking part is equipped with guiding surfaces in both the horizontal direction and the vertical direction so as to allow the plug housing to be inserted into the receiving space either along the front-to-back direction or the vertical direction.

2. The electrical connector assembly as claimed in claim 1, wherein each latch forms a mounting part extending downwardly through the receptacle housing for mounting to a printed circuit board on which the receptacle connector is mounted.

3. The electrical connector assembly as claimed in claim 1, wherein each latch forms a U-shaped structure having an inner arm with the locking part thereon.

4. The electrical connector assembly as claimed in claim 3, wherein the locking part is formed at a free end of the inner arm.

5. The electrical connector assembly as claimed in claim 3, wherein the locking part is an embossment formed on an inner surface of the inner arm.

6. The electrical connector assembly as claimed in claim 1, wherein the receiving space forwardly communicates with an exterior in the front-to-back direction to allow the corresponding latch to be inserted thereinto from the exterior.

7. The electrical connector assembly as claimed in claim 1, wherein the plug housing forms a pair of locking grooves and a pair of offsetting grooves in two opposite lateral sides, and the locking part is received within the locking groove.

8. The electrical connector assembly as claimed in claim 1, wherein the rear wall of the receptacle housing from a pair of positioning blocks and the front end of the plug housing forms a pair of positioning blocks adapted to be received within the positioning holes during mating.

9. The electrical connector assembly as claimed in claim 1, wherein the plug housing forms a plurality of mating slots communicating with an exterior in both the front-to-back direction and the vertical direction.

10. The electrical connector assembly as claimed in claim 1, wherein the receptacle housing further includes a bottom wall linked with the rear wall and the pair of side walls to commonly form the receiving space.

* * * * *